US009004141B2

(12) United States Patent
Chen

(10) Patent No.: US 9,004,141 B2
(45) Date of Patent: Apr. 14, 2015

(54) COVERING DEVICE OF OPENING OF BUILDING

(71) Applicant: Nien Made Enterprise Co., Ltd., Taichung (TW)

(72) Inventor: Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 29 days.

(21) Appl. No.: 13/927,653

(22) Filed: Jun. 26, 2013

(65) Prior Publication Data

US 2014/0262082 A1 Sep. 18, 2014

(30) Foreign Application Priority Data

Mar. 12, 2013 (CN) ..... 2013 2 0111953 U

(51) Int. Cl.

| | |
|---|---|
| ***A47H 5/00*** | (2006.01) |
| ***E06B 9/24*** | (2006.01) |
| *E06B 9/58* | (2006.01) |

(52) U.S. Cl.
CPC .... *E06B 9/24* (2013.01); *E06B 9/58* (2013.01)

(58) Field of Classification Search
USPC ..... 160/276, 280, 248, 278, 285, 287, 281, 160/284, 282, 277, 274, 213, 207, 84.06, 160/172 R
See application file for complete search history.

(56) References Cited

U.S. PATENT DOCUMENTS

| | | | | |
|---|---|---|---|---|
| 272,898 | A * | 2/1883 | Pepper | 160/248 |
| 1,033,224 | A * | 7/1912 | Andlauer | 160/274 |
| 2,041,410 | A * | 5/1936 | Goodman | 160/207 |
| 2,131,521 | A * | 9/1938 | Nye | 160/278 |
| 4,448,232 | A * | 5/1984 | McQueen et al. | 160/207 |
| 4,637,446 | A * | 1/1987 | McQueen et al. | 160/207 |
| 6,959,748 | B2 * | 11/2005 | Hudoba | 160/31 |
| 8,347,937 | B2 * | 1/2013 | Murphy | 160/84.04 |
| 2014/0262082 | A1 * | 9/2014 | Chen | 160/327 |

* cited by examiner

*Primary Examiner* — Blair M Johnson
(74) *Attorney, Agent, or Firm* — Ming Chow; Sinorica, LLC

(57) ABSTRACT

A covering device of an opening of a building includes two parallel rails, a shading member, a main member, and two adjusting units. Each rail has a first side and a second side. The main member is between the rails and is connected to an end of the shading member. The main member has two coupling members to engage the rails at the first sides thereof. The adjusting unit has a stop member to be moved between a first position and a second position. The stop member touches the second side of the rail while the stop member is moved to the first position, and is off the second side of the rail while the stop member is moved to the second position.

12 Claims, 8 Drawing Sheets

COVERING DEVICE OF OPENING OF BUILDING

The current application claims a foreign priority to the patent application of China No. 201320111953.6 filed on Mar. 12, 2013.

BACKGROUND OF THE INVENTION

1. Technical Field

The present invention relates to a covering, and more particularly to a covering device of an opening of a building, and a coupling module of the covering device.

2. Description of Related Art

A building usually has lots of openings to be an entrance of a room or the building or for ventilation. A glass window usually is mounted in the opening for ventilation, and a window covering is mounted in the opening for shading the window. The conventional window covering is fixed to the wall. Sometime, the window covering has to be taken off for maintaining or cleaning. It is a hard job to take the conventional window covering off the wall.

BRIEF SUMMARY OF THE INVENTION

In view of the above, the primary objective of the present invention is to provide a window device of an opening of a building and a coupling module of the window covering, which makes the job of mounting and taking off the window device easier.

In order to achieve the objective of the present invention, a covering device of an opening of a building of the present invention includes two parallel rails, a shading member, a main member, and at least an adjusting unit. Each rail has a first side and a second side, and the first side and the second side are on opposite sides of the rail. The main member is between the rails and is connected to an end of the shading member. The main member has two coupling members to engage the rails respectively, and each of the coupling members has a front stop face touching the first side of the corresponding rail. The adjusting unit is provided to the main member to be moved between a first position and a second position. The adjusting unit has a stop member, and the stop member has a rear stop face. The rear stop face of the stop member touches the second side of the rail while the adjusting unit is moved to the first position, and the rear stop face is off the second side of the rail while the adjusting unit is moved to the second position.

The present invention further provides a coupling module, which is incorporated in a covering device for an opening of a building, including an elongated main member, two coupling members, and at least an adjusting unit. The coupling members are provided on opposite ends of the main member, and each of the coupling members has a front stop face. The adjusting unit is provided to the main member, which has a stop member to be moved between a first position and a second position. The stop member has a rear stop face. The rear stop face of the stop member faces the front stop face of the coupling member to form a holding space therebetween while the stop member is moved to the first position, and the rear stop face is in the main member while the stop member is moved to the second position.

With such design, the shading member is able to be assembled or disassembled in an easy way.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
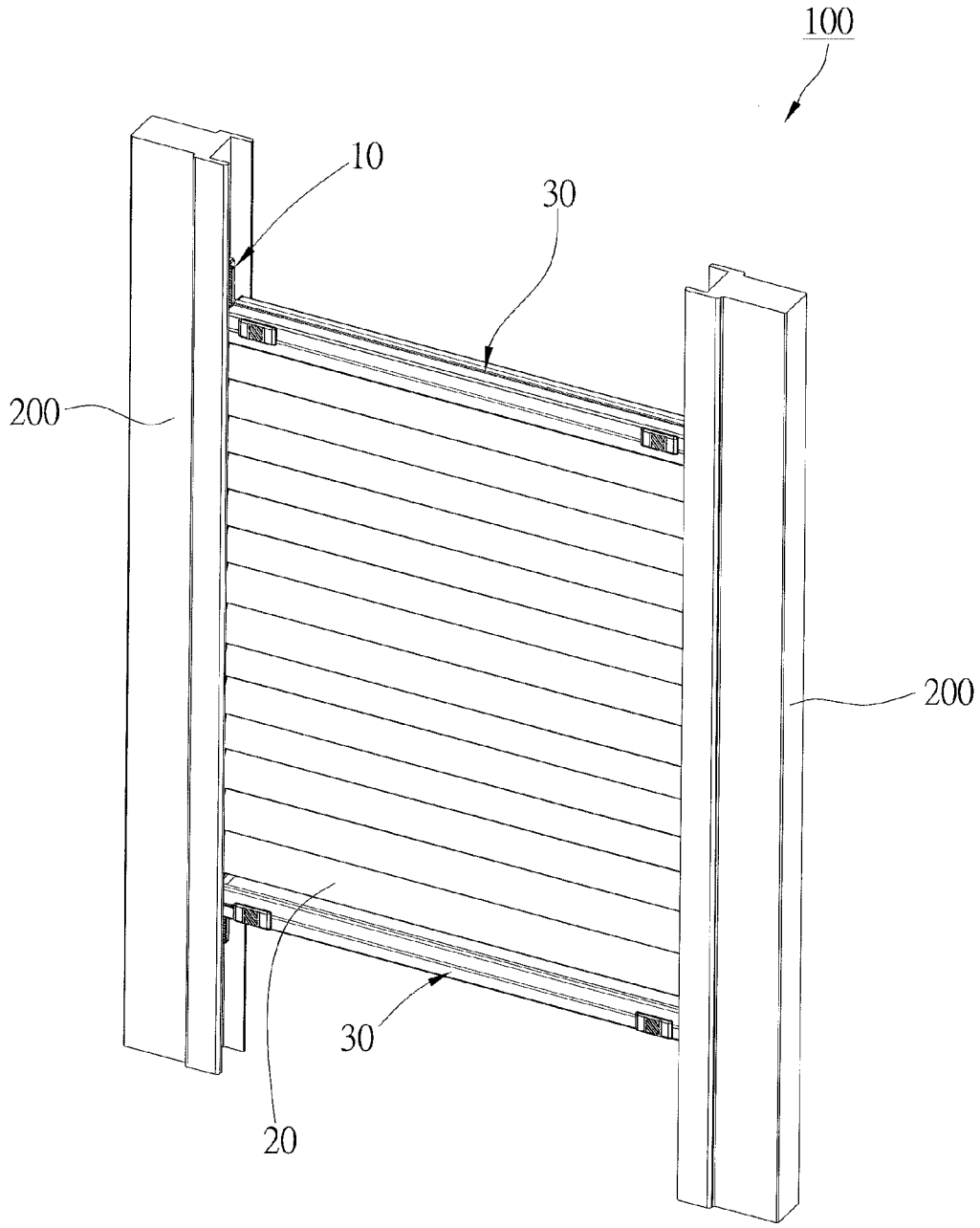
FIG. 1 is a perspective view of a preferred embodiment of the present invention.
Figure 2:
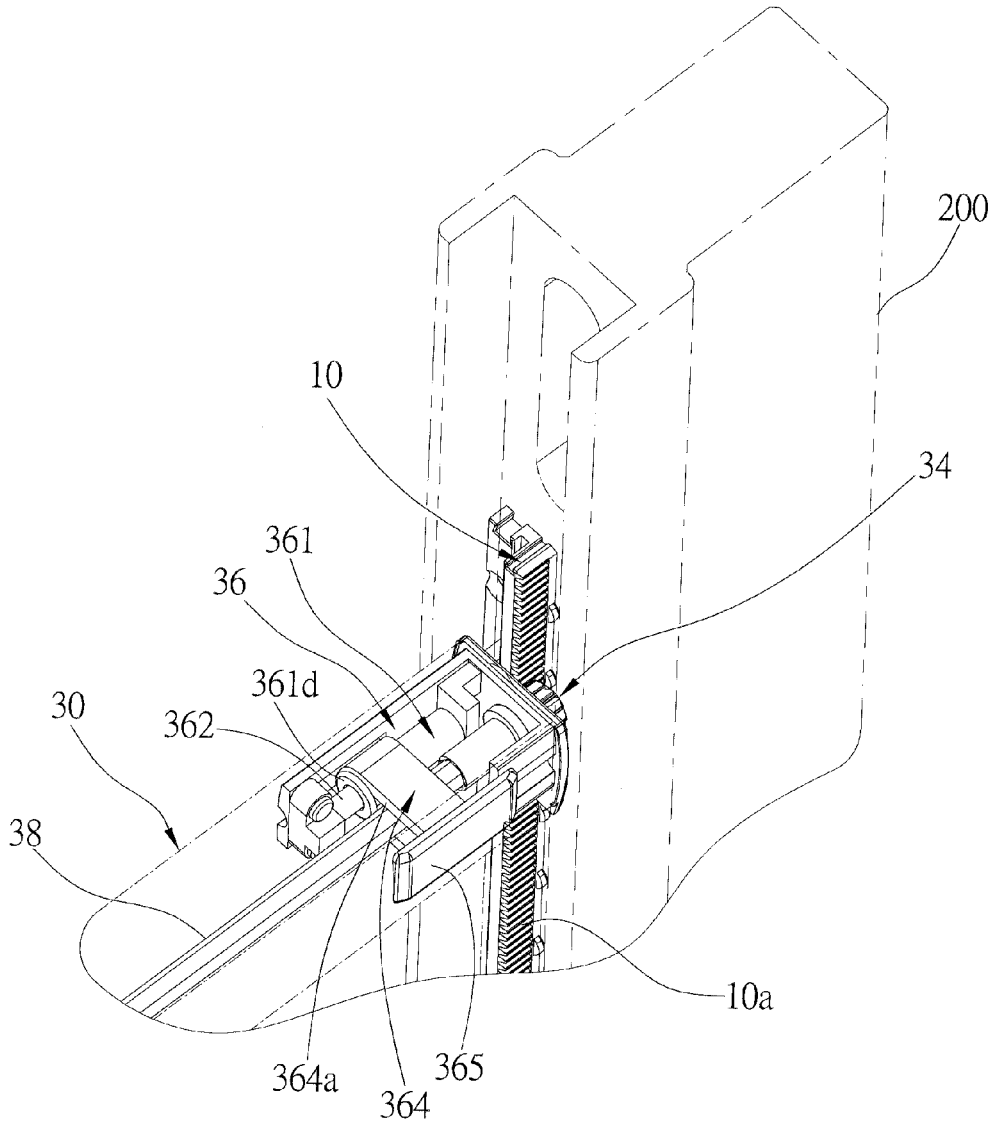
FIG. 2 is a perspective view of the preferred embodiment of the present invention, showing the adjusting unit and the rail.
Figure 3:
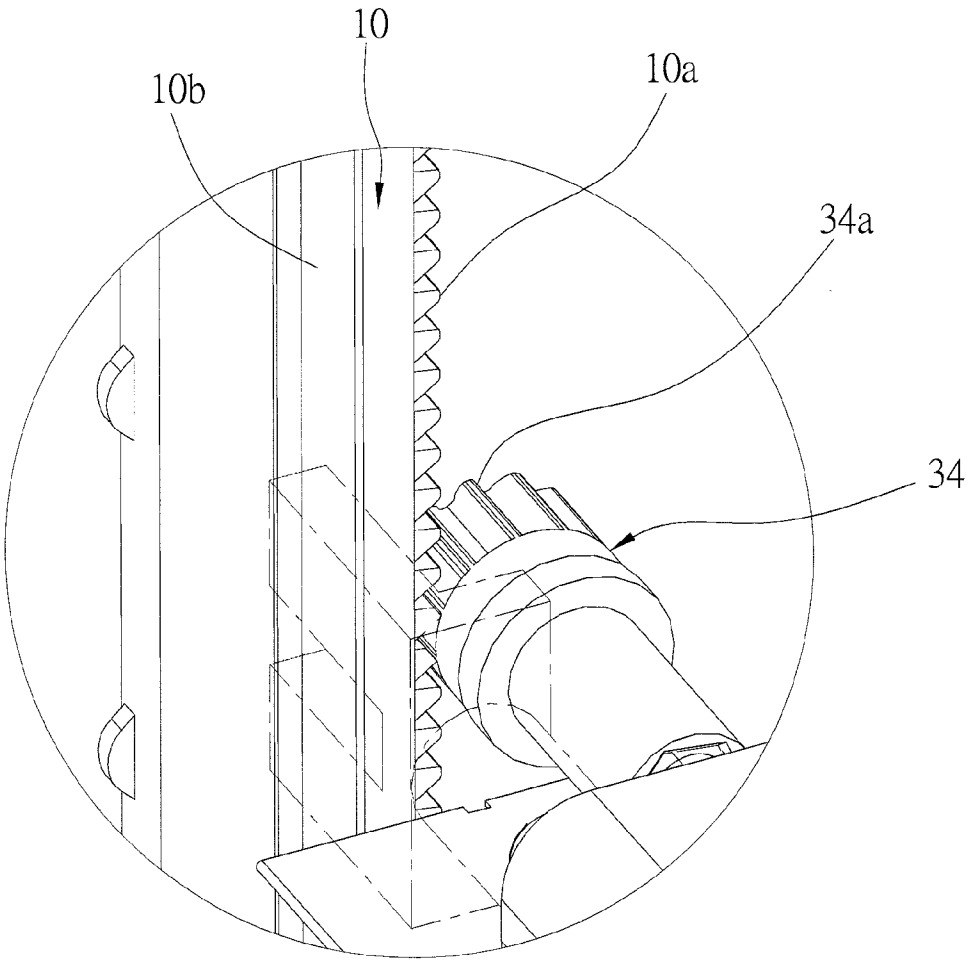
FIG. 3 is a perspective view of the preferred embodiment of the present invention, showing the gear, the stop member and the rail.

As shown in FIG. 1 to FIG. 3, a covering device 100 of an opening of a building of the preferred embodiment of the present invention includes two rails 10, a shading member 20, and two coupling modules 30. The rails 10 are parallel and mounted on a frame 200. The shading member 20, which is a shading blanket in the present invention, is set between the rails 10. The coupling modules 30 are connected to a top and a bottom of the shading member 20, and each coupling module 30 has opposite ends engaging the rails 10. The structures for engagement of each of the coupling module 30 and the rail 10 are the same, so we only describe one set of them in the following.

The rail 10 has a rack thereon on a first side 10*a* and a second side 10*b* which is opposite to the first side 10*a*.

As shown in FIG. 4 to FIG. 8, the coupling module 30 has a main member 32, two coupling members 34, and two adjusting units 36. The main member 32 has an elongated tubular member 321 and two lids 322 engaging the tubular member 321 at opposite ends thereof. The tubular member 321 has an L-shaped slot 321*a*. Each lid 322 has two first bores 322*a* and a second bore 322*b*. The main member 32 is between the rails 10 and connected to the shading member 20.

A shaft 38 is received in the tubular member 321, and two ends of the shaft 38 pass through the second bores 322*b* of the lids 322. The coupling members 34 are two gears connected to the opposite ends of the shaft 38, which means the coupling members 34 are left out of the main member 32 and are free to rotate. The coupling member 34 has teeth to engage the rack on the first side 10*a* of the rail 10. The teeth of the gear form a front stop face 34*a* of the coupling members 34. The shaft 38 makes the coupling members 34 simultaneously rotate that the coupling module 30 may move up and down smoothly.

Figure 6:
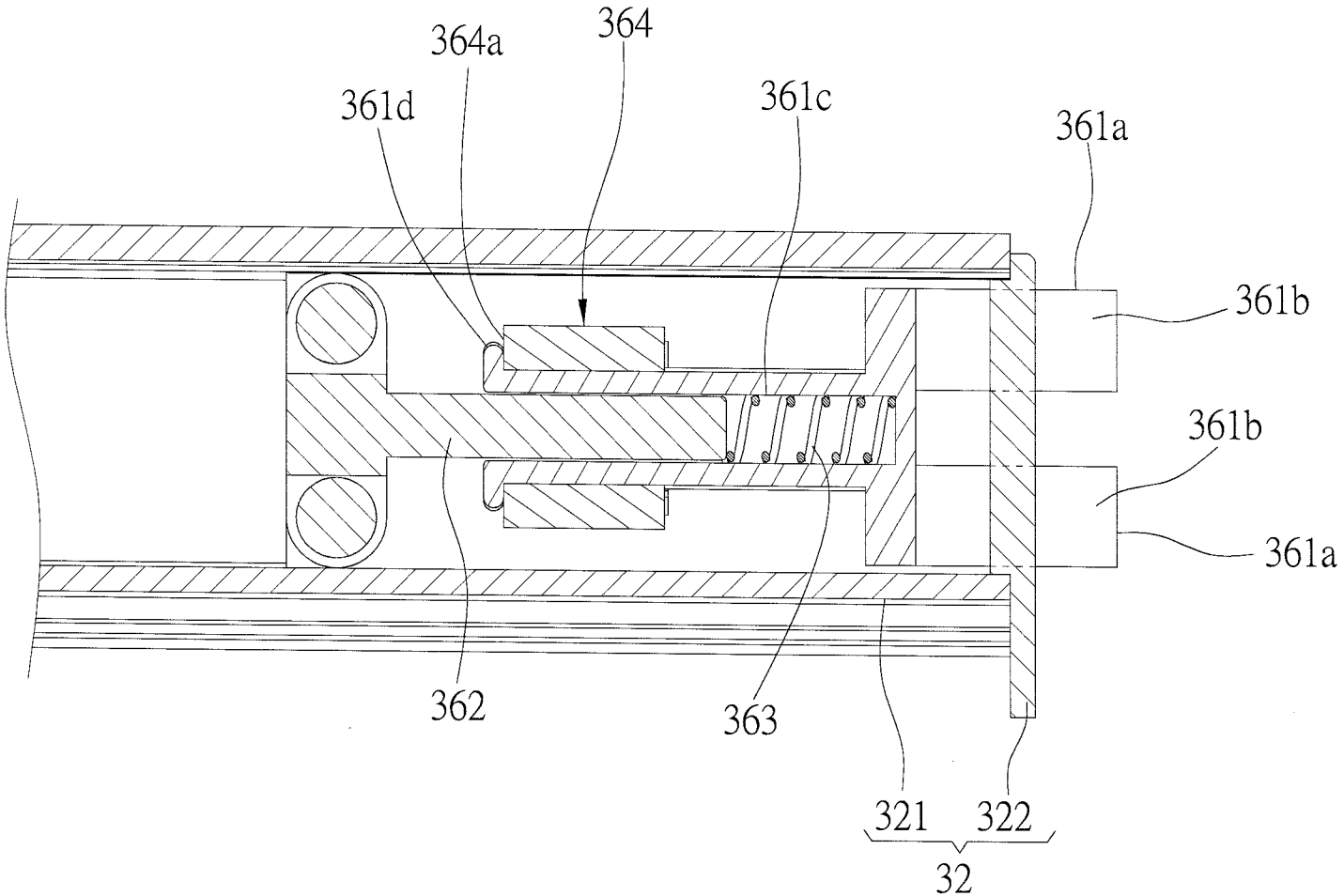
FIG. 6 is a sectional view of the 6-6' line in FIG. 4.

The adjusting units 36 are provided on opposite ends of the main member 32, each of which has a stop member 361, a guiding shaft 362, a spring 363, a connecting member 364, and a switching plate 365. The stop member 361 has two protrusions 361*a* at an end thereof. The protrusions 361*a* respectively are inserted into the first bores 322*a* of the lid 322. Each protrusion 361*a* has a rear stop face 361*b*. The stop member 361 further has a recess 361*c* (FIG. 6).

The guiding shaft 362 has an end fixed to the tubular member 321, and the other end inserted into the recess 361*c*. The spring 363 is received in the recess 361*c* of the stop member 361, and is between the guiding shaft 362 and the bottom of the recess 361*c*, so that the stop member 361 is urged by the spring 363 to make the protrusion 361*a* normally extends out of the lid 322 via the first bores 322*a*.

The connecting member 364 is connected to the stop member 361 and the switching plate 365. In an embodiment, the connecting member 364 is a U-shaped member. The stop member 361 is fit to a turned portion of the connecting member 364, therefore the connecting member 364 is able to rotate relative to the stop member 361. The stop member 361 has a flange 361*d* around the recess 361*c* against an edge 364*a* of the connecting member 364. The switching plate 365 is set outside the tubular member 321, and the connecting member 364 is connected to the switching plate 365 through the slot 321*a*. Therefore, a user may move the switching plate 365 in the L-shaped slot 321*a* to move the stop member 361.

Figure 4:
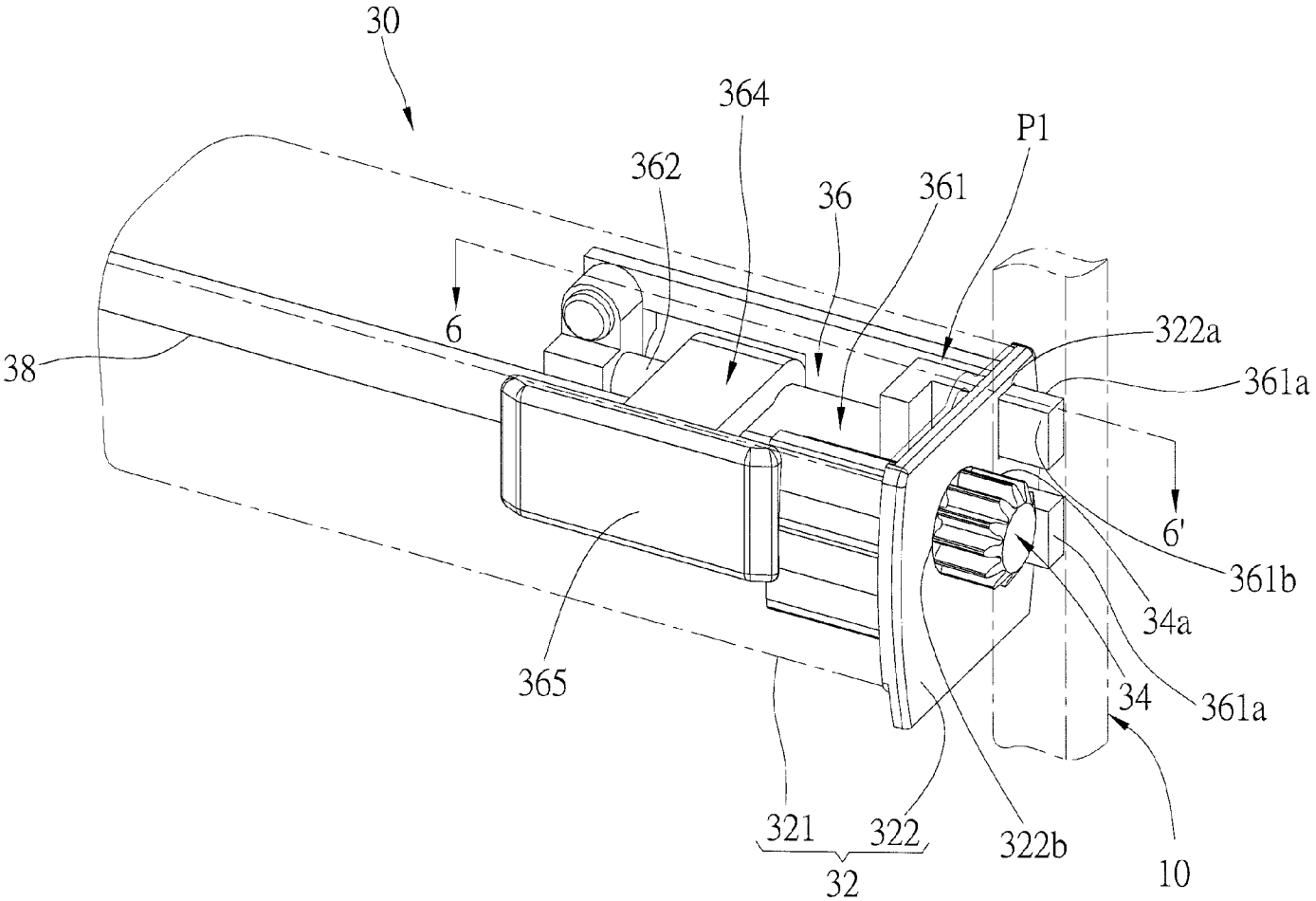
FIG. 4 is a perspective view of the preferred embodiment of the present invention, showing the protrusion out of the lid.
Figure 5:
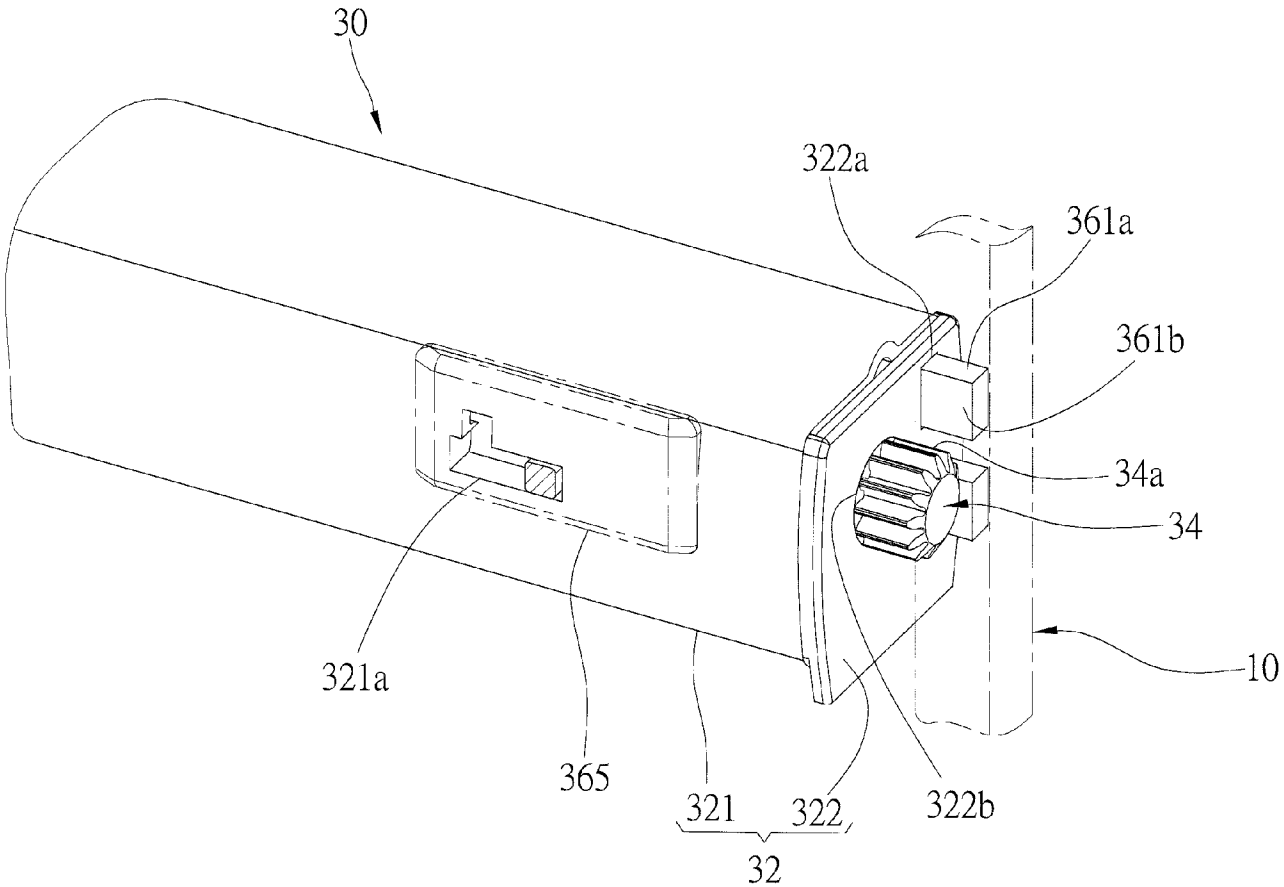
FIG. 5 is a perspective view of the preferred embodiment of the present invention, showing the elongated opening of the main member.

As shown in FIG. 4 and FIG. 5, in a normal condition, the stop member 361 is urged by the spring 363 to move to a first position P1, in which the protrusions 361*a* extend out of the lid 322 via the first bores 322*a*. At the first position, the rear stop face 361*b* of the protrusion 361*a* faces the front stop face 34*a* of the coupling member 34 to form a holding space therebetween. While the stop member 361 is moved to the first position P1, the rail 10 is in the holding space to make the teeth of the coupling member 34 unable to disengage the rack of the rail 10, and allow the coupling module 30 to move on the rail 10.

Figure 7:
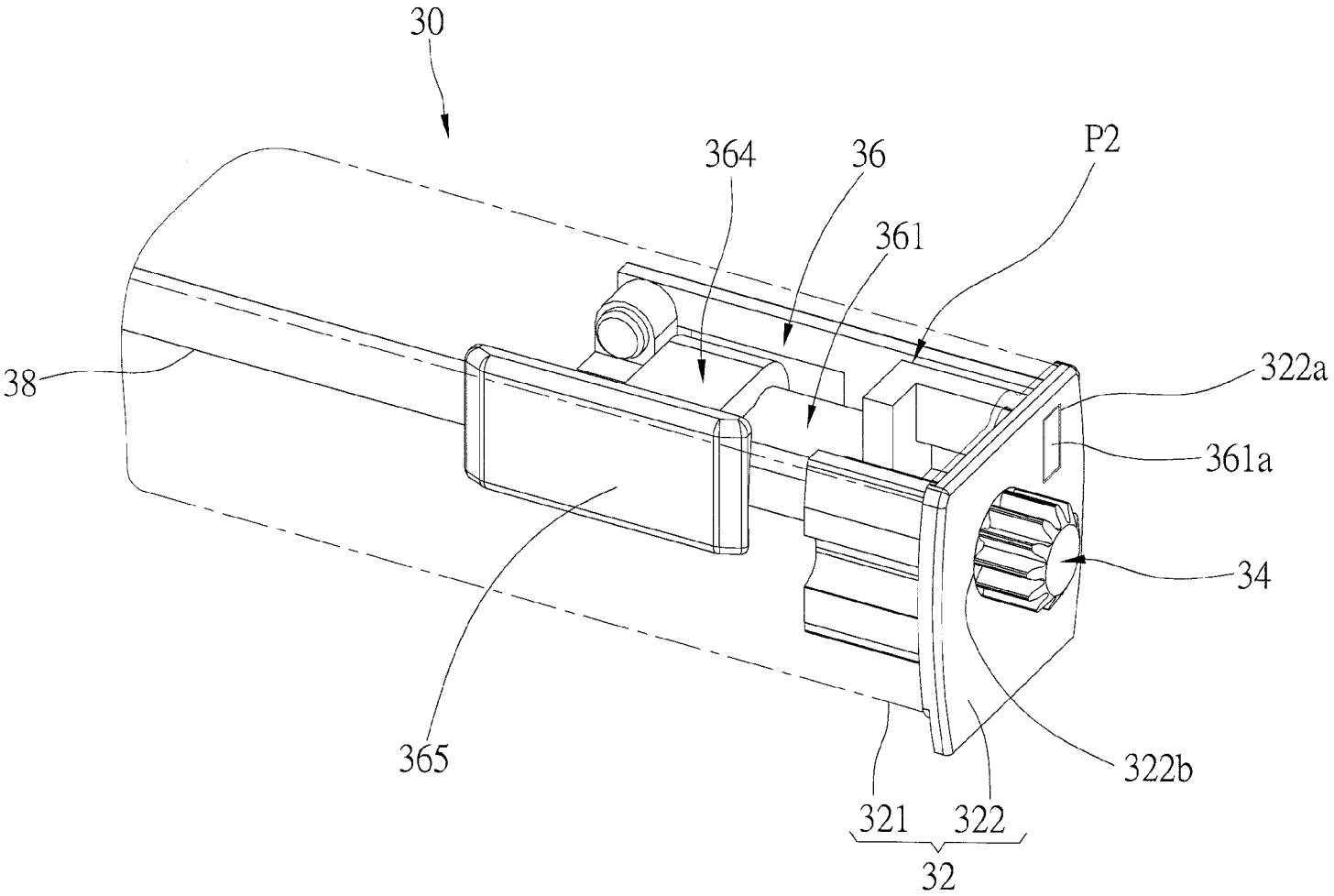
FIG. 7 is a perspective view of the preferred embodiment of the present invention, showing the protrusion in the through hole.
Figure 8:
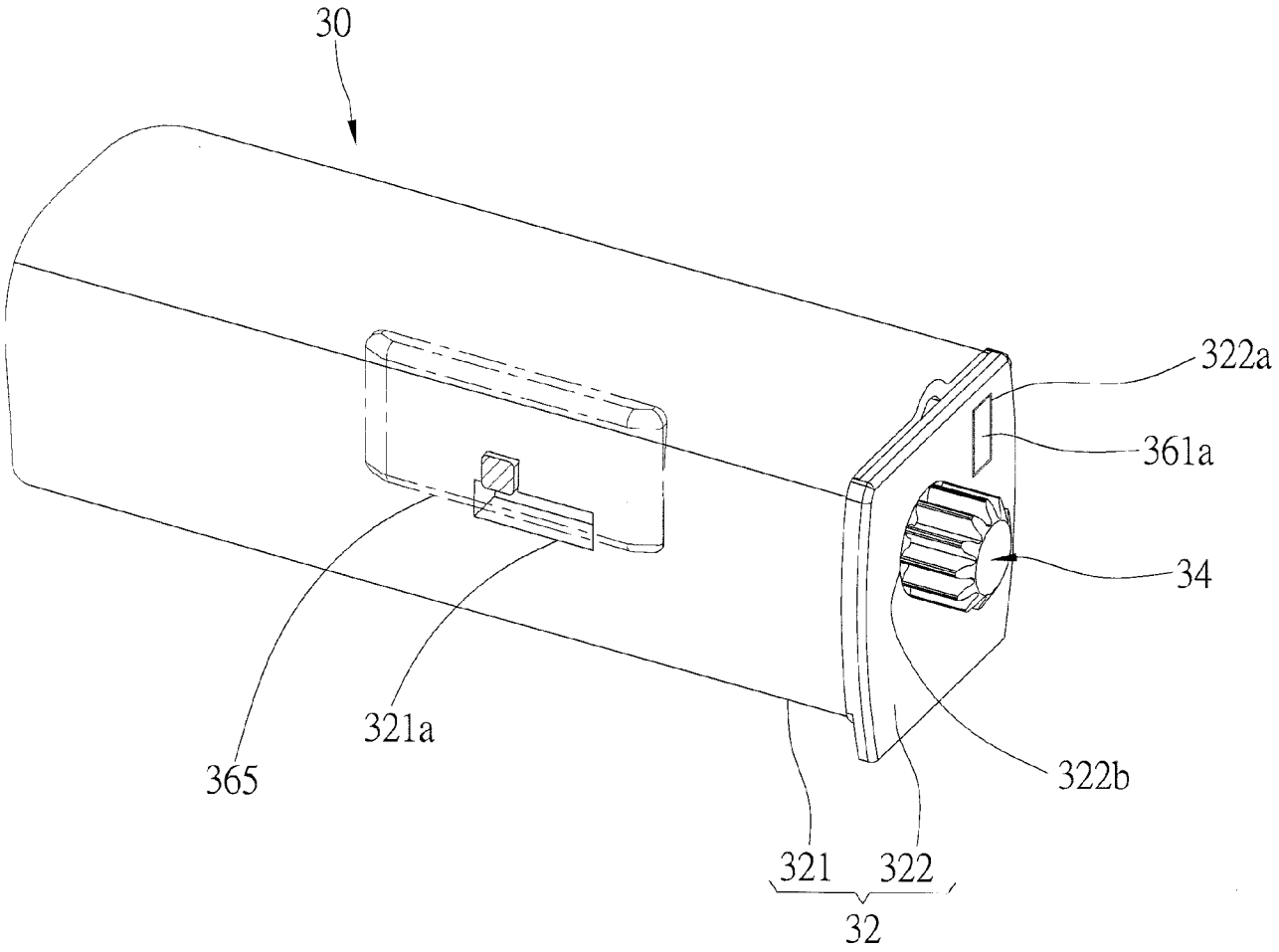
FIG. 8 is a perspective view of the preferred embodiment of the present invention, showing the switching plate.

As shown in FIG. 7 and FIG. 8, while the user moves the switching plate 365 to the left, and then moves upwards to the opposite end of the L-shaped slot 321*a*, the protrusions 361*a* now are moved to a second position P2, and are held right there. In this position, the protrusions 361*a* are off the rail 10, and the teeth of the coupling member 34 is able to disengage the rack of the rail 10. As a result, the shading member 20 may be taken off from the rails 10 if all the stop members 361 are moved to the second positions P2.

In conclusion, the user only has to move the switching plate 365 to assemble or disassemble the shading member 20. No tool is needed.

In an embodiment, there is only one adjusting unit 36 in the coupling module 30. In other words, one end of the main member 32 has a movable protrusion like above, and the other end of the main member 32 has a fixed protrusion. User may assemble or disassemble the shading member 20 by moving the switching plate 365. Besides, the lids 322 are not an necessary element in the present invention. The coupling module 30 may still work without the lid. In an embodiment, the shading member 20 is provided with one coupling module 30 at one end, and the other end of the shading member 20 is fixed. The shading member 20 may be extended and folded by moving the coupling module 30.

It must be pointed out that the embodiments described above are only some preferred embodiments of the present invention. All equivalent structures which employ the concepts disclosed in this specification and the appended claims should fall within the scope of the present invention.

What is claimed is:

1. A covering device of an opening of a building, comprising:

two parallel rails, each of which has a first side and a second side, wherein the first side and the second side are on opposite sides of the rail;

a shading member between the rails;

a main member between the rails and connected to an end of the shading member, wherein the main member has two coupling members to engage the rails respectively, and each of the coupling members has a front stop face touching the first side of the corresponding rail;

at least an adjusting unit provided to the main member to be moved between a first position and a second position, wherein the adjusting unit has a stop member, and the stop member has a rear stop face;

a shaft received in the main member, wherein both the coupling members of the main member are connected to the shaft; and wherein the rear stop face of the stop member touches the second side of the rail while the adjusting unit is moved to the first position, and the rear stop face is off the second side of the rail while the adjusting unit is moved to the second position.

2. The covering device of claim 1, wherein the adjusting unit further has a connecting member and a switching plate; the connecting member is connected to the stop member; the main member has an elongated slot; the connecting member is connected to the switching plate through the slot, whereby the stop member is moved by moving the switching plate.

3. The covering device of claim 2, wherein the adjusting unit has a guiding shaft; the stop member has a recess; and the guiding shaft has an end inserted into the recess.

4. The covering device of claim 3, wherein the adjusting unit further has a spring received in the recess of the stop member; and the spring is set between the guiding shaft and a bottom of the recess.

5. The window covering of claim 2, wherein the main member has a bore; the stop member has a protrusion, on which the rear stop face is provided; the protrusion extends out of the main member via the bore when the adjusting unit is moved to the first position; and the protrusion is received within the main member when the adjusting unit is moved to the second position.

6. The covering device of claim 1, wherein the rail has a rack on the first side, and the coupling member is a gear meshed with the rack.

7. The covering device of claim 1, wherein the rail has a rack on the first side, and the coupling member is a gear meshed with the rack.

8. A coupling module, which is incorporated in a covering device for an opening of a building, comprising:

an elongated main member;

two coupling members provided on opposite ends of the main member, wherein each of the coupling members has a front stop face;

at least an adjusting unit provided to the main member, wherein the adjusting unit has a stop member to be moved between a first position and a second position, and the stop member has a rear stop face;

a shaft received in the main member, wherein both the coupling members of the main member are connected to the shaft; and wherein the rear stop face of the stop member faces the front stop face of the coupling member to form a holding space therebetween while the stop member is moved to the first position, and the rear stop face is within the main member while the stop member is moved to the second position.

9. The coupling module of claim 8, wherein the adjusting unit further has a connecting member and a switching plate; the connecting member is connected to the stop member; the main member has an elongated slot; the connecting member is connected to the switching plate through the slot, whereby the stop member is moved by moving the switching plate.

10. The coupling module of claim 9, wherein the adjusting unit has a guiding shaft; the stop member has a recess; and the guiding shaft has an end inserted into the recess.

11. The coupling module of claim 10, wherein the adjusting unit further has a spring received in the recess of the stop member; and the spring is set between the guiding shaft and a bottom of the recess.

12. The coupling module of claim 9, wherein the main member has a bore; the stop member has a protrusion, on which the rear stop face is provided.

* * * * *